US009323225B2

(12) United States Patent
Maruyama

(10) Patent No.: US 9,323,225 B2
(45) Date of Patent: Apr. 26, 2016

(54) TIMEPIECE

(71) Applicant: CASIO COMPUTER CO., LTD., Shibuya-ku, Tokyo (JP)

(72) Inventor: Yoshihiro Maruyama, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/798,054

(22) Filed: Jul. 13, 2015

(65) Prior Publication Data

US 2016/0062316 A1 Mar. 3, 2016

(30) Foreign Application Priority Data

Aug. 29, 2014 (JP) ..... 2014-175397

(51) Int. Cl.
*G04B 37/08* (2006.01)
*G04B 37/11* (2006.01)

(52) U.S. Cl.
CPC ..... *G04B 37/08* (2013.01); *G04B 37/11* (2013.01)

(58) Field of Classification Search
CPC ... G04G 37/005; G04G 37/08; G04G 37/082; G04G 37/11; G04G 37/113
See application file for complete search history.

(56) References Cited

U.S. PATENT DOCUMENTS 3,643,424 A * 2/1972 Simon ..... G04B 37/055 368/291
6,527,435 B2 * 3/2003 Thalheim ..... G04B 37/11 368/281
6,761,479 B2 * 7/2004 Meyrat ..... G04B 37/0033 368/281
6,788,623 B2 * 9/2004 Hiranuma ..... G04B 37/084 368/281
7,431,495 B2 * 10/2008 Cretin ..... G04B 37/055 368/287
2008/0025152 A1 * 1/2008 Yano ..... G04B 37/11 368/47

FOREIGN PATENT DOCUMENTS

JP 2009008497 A 1/2009

* cited by examiner

*Primary Examiner* — Vit W Miska
(74) *Attorney, Agent, or Firm* — Holtz, Holtz & Volek PC

(57) ABSTRACT

A timepiece provided with a metal case having a fitting section which is annularly provided in a lower portion of the inner circumferential surface, a metal lid body having a lid main body section which is arranged on a lower end of the case and covers a lower portion of the case and a cylindrical section which is arranged in the fitting section of the case, and a synthetic resin gasket having a gasket main body section which is arranged between the fitting section of the case and the cylindrical section of the lid body and a spacer section which forms a space between a lower end surface of the case and an upper surface of the lid main body section.

20 Claims, 8 Drawing Sheets

TIMEPIECE

CROSS-REFERENCE TO RELATED APPLICATION

This application is based upon and claims the benefit of priority from the prior Japanese Patent Application No. 2014-175397, filed Aug. 29, 2014, the entire contents of which are incorporated herein by reference.

BACKGROUND OF THE INVENTION

1. Field of the Invention

The present invention relates to a timepiece.

2. Description of the Related Art

A timepiece is known which includes a timepiece case having a case main body and a body section and in which a timepiece glass has been attached on an upper opening of the case main body, a rear lid has been attached on a lower portion of the case main body by a plurality of screws, and the body section has been held between the case main body and the rear lid, as described in, for example, Japanese Patent Application Laid-Open (Kokai) Publication No 2009-008497.

In this type of timepiece, when the body section is to be held between the case main body and the rear lid, a gasket is arranged between the case main body and the body section, and another gasket is arranged between the rear lid and the body section. In this state, by the rear lid being attached on the case main body by the fastening of the plurality of screws, the body section is held between the case main body and the rear lid.

However, in this timepiece, the case main body and the rear lid have been attached together by fastening the plurality of screws with the case main body and the rear lid being in direct contact with each other. Therefore, the fastened states of the plurality of screws vary due to temporal change. As a result, the state of each contact between the case main body and the rear lid corresponding to each of the plurality of screws varies, which causes the entire timepiece case to be in an electrically unstable state and thereby hinders the tuning and the receiving sensitivity of an antenna incorporated in the timepiece case.

The present invention provides a timepiece capable of ensuring waterproofness and maintaining an electrically stable state.

SUMMARY OF THE INVENTION

In accordance with one aspect of the present invention, there is provided a timepiece comprising: a metal case having a fitting section which is annularly provided in a lower portion of an inner circumferential surface; a metal lid body having a lid main body section which is arranged on a lower end of the case and covers a lower portion of the case and a cylindrical section which is arranged in the fitting section of the case; and a synthetic resin gasket having a gasket main body section which is arranged between the fitting section of the case and the cylindrical section of the lid body and a spacer section which forms a space between a lower end surface of the case and an upper surface of the lid main body section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 3A to FIG. 3C show members at the engagement portion between the wristwatch case and the rear lid shown in FIG. 2, of which FIG. 3A is an enlarged sectional view of the main portion of a case main body, FIG. 3B is an enlarged sectional view of the main portion of the rear lid, and FIG. 3C is an enlarged sectional view of the main portion of a rear-lid gasket;

FIG. 4A and FIG. 4B show a notched portion and a cutout portion in the engagement portion between the wristwatch case and the rear lid shown in FIG. 2, of which FIG. 4A is an enlarged plan view of the main portion showing the nine o'clock side of the rear lid having the rear-lid gasket mounted thereon and FIG. 4B is an enlarged sectional view of the main portion taken along line A-A of FIG. 4A;

FIG. 8A to FIG. 8C show members at the engagement portion between the wristwatch case and the rear lid shown in FIG. 7, of which FIG. 8A is an enlarged sectional view of the main portion of a case main body, FIG. 8B is an enlarged sectional view of the main portion of the rear lid, and FIG. 8C is an enlarged sectional view of the main portion of a rear-lid gasket.

DETAILED DESCRIPTION OF THE PREFERRED EMBODIMENTS

First Embodiment

Hereafter, a first embodiment in which the present invention has been applied to a wristwatch is described with reference to FIG. 1 to FIG. 4A and FIG. 4B.

Figure 1:
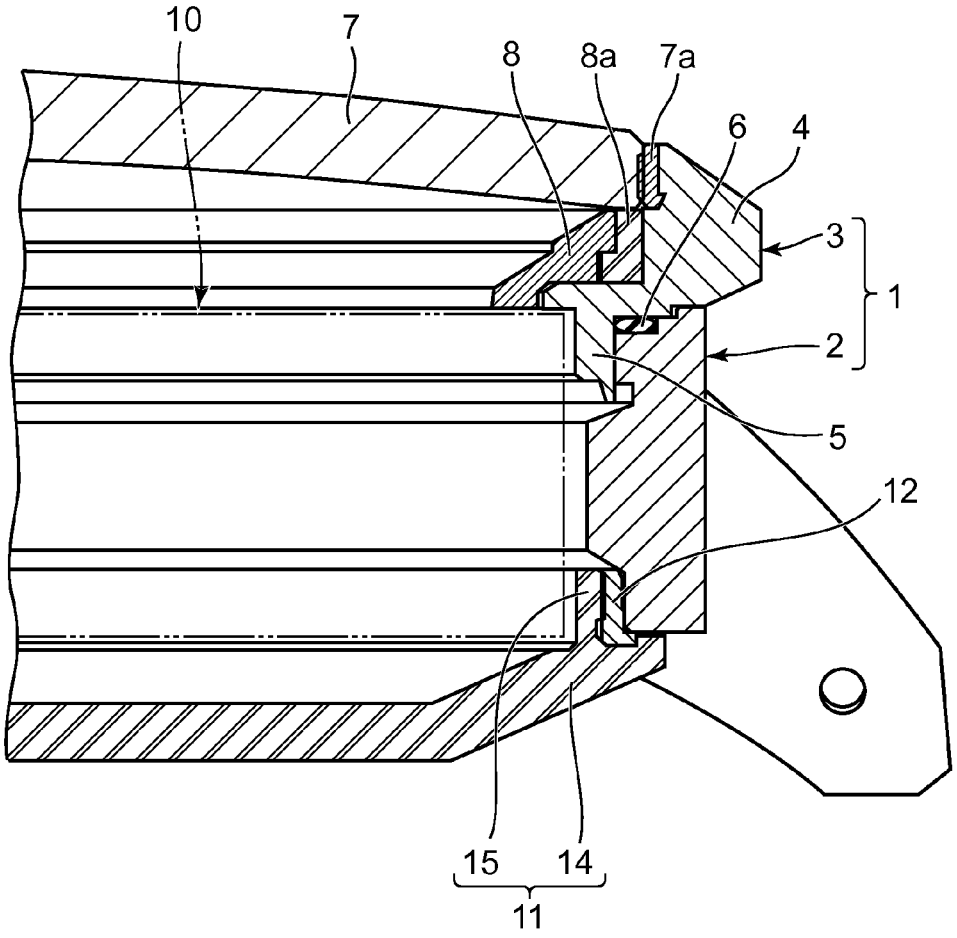
FIG. 1 is an enlarged sectional view of the main portion of a first embodiment in which the present invention has been applied in a wristwatch.

This wristwatch includes a wristwatch case 1 as shown in FIG. 1, which has a case main body 2 (case) and a bezel 3. The case main body 2 is formed into a substantially cylindrical shape and made of metal such as stainless steel or titanium. The bezel 3 is formed into a substantially ring shape and made of metal identical to the metal of the case main body 2.

The bezel 3 has a bezel main body section 4 arranged at an upper end portion of the case main body 2 and a leg section 5 provided on an inner circumferential edge of the bezel main body section 4, as shown in FIG. 1. In this embodiment, the bezel main body section 4 has an outer perimeter larger than that of the case main body 2. Also, the bezel main body section 4 is formed to have an inner perimeter larger than the inner perimeter of the case main body 2 and smaller than the outer perimeter of the case main body 2. The leg section 5 is formed having an outer perimeter equal to the inner perimeter of the case main body 2.

As a result, the bezel 3 is structured such that the leg section 5 is fitted into the case main body 2, and the lower surface of the bezel main body section 4 comes in contact with the upper surface of the case main body 2 by being pressed, whereby the bezel 3 is mounted on an upper portion of the case main body 2, as shown in FIG. 1. In this embodiment, waterproof ring 6 is arranged between the upper surface of the case main body 2 and the lower surface of the bezel main body section 4. The wristwatch case 1 is structured by these components.

On the inner side of the bezel 3, that is, on the upper opening of the wristwatch case 1, a timepiece glass 7 and a parting plate 8 are mounted, as shown in FIG. 1. In this embodiment, the parting plate 8 is formed into a ring shape, and fitted into the bezel 3 via a parting gasket 8*a* so as to be arranged on the bottom inside the bezel 3. The timepiece glass 7 is formed into a disk shape, and fitted into the bezel 3 via a glass gasket 7*a* so as to be arranged on the parting gasket 8*a*.

Inside the wristwatch case 1, that is, inside the case main body 2, a timepiece module 10 is incorporated, as shown in FIG. 1. The timepiece module 10 includes, although not depicted, various electronic components required for a timepiece function, such as a timepiece movement, an antenna, and a circuit board. In this embodiment, the antenna is, for example, an antenna for GPS or a long-wave antenna for receiving a standard time wave.

Figure 2:
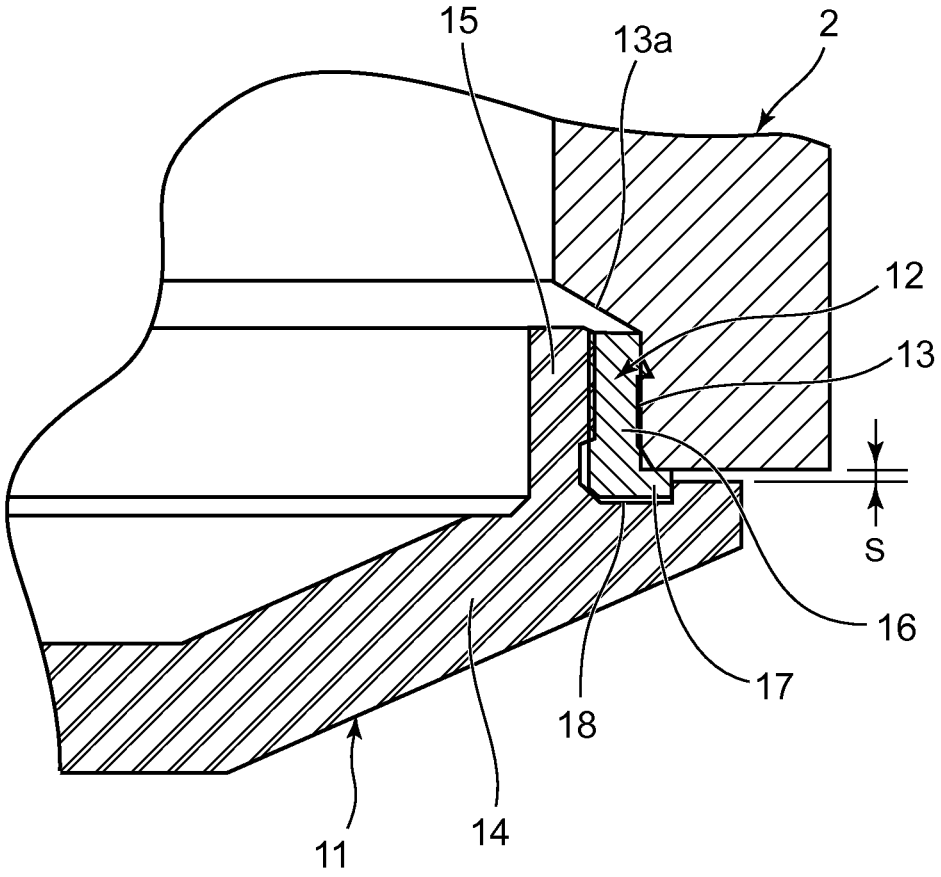
FIG. 2 is an enlarged sectional view of the main portion of an engagement portion between the wristwatch case and the rear lid of the wristwatch shown in FIG. 1.
Figure 3A:
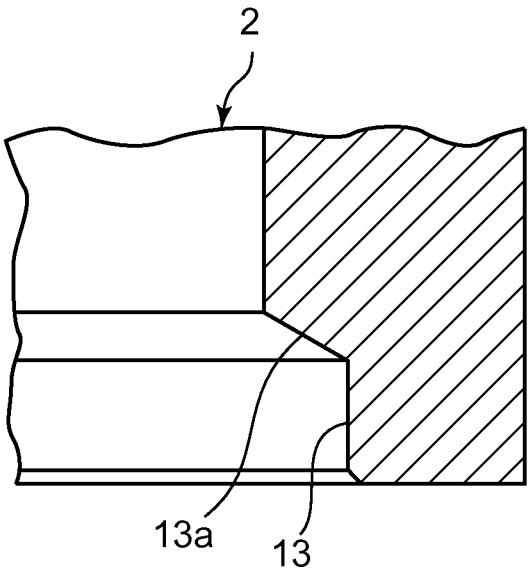

On a lower portion of the wristwatch case 1, that is, on a lower portion of the case main body 2, a rear lid 11 (lid body) is mounted via a rear-lid gasket 12 (gasket), as shown in FIG. 1 and FIG. 2. In this embodiment, on a lower portion of the inner circumferential surface of the case main body 2, a fitting section 13 is annularly provided along the inner circumferential surface of the case main body 2. The fitting section 13 is open toward the inner circumferential surface side of the case main body 2, its lower portion is open downward from the lower end of the case main body 2, and its upper portion is formed as an inclined surface 13*a* upwardly inclined toward the inner circumferential surface of the case main body 2, as shown in FIG. 3A.

As with the case main body 2, the rear lid 11 is formed of metal such as a stainless steel or titanium, and includes a lid main body section 14 arranged at the lower end of the case main body 2 to close the case main body 2 and a cylindrical section 15 arranged in the fitting section 13 of the case main body 2, which have been integrally formed, as shown in FIG. 1 and FIG. 2. The lid main body section 14 is formed into a substantially disk shape, and has an outer perimeter larger than the inner perimeter of the fitting section 13 of the case main body 2 and smaller than the outer perimeter of the case main body 2.

Figure 3B:
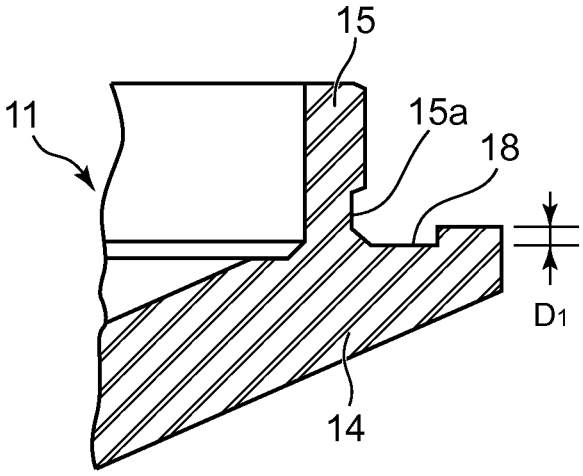

The cylindrical section 15 of the rear lid 11 is formed integrally on the upper surface of the lid main body 14, and has an inner perimeter substantially equal to the inner perimeter of the case main body 2 and an outer perimeter smaller than the inner perimeter of the fitting section 13 of the case main body 2, as shown in FIG. 2 and FIG. 3B. As a result, the thickness of the cylindrical section 15 in the radial direction is shorter than the depth of the fitting section 13 of the case main body 2, that is, the length of the fitting section 13 in the radial direction.

The rear lid gasket 12 is formed of synthetic resin such as polyamide resin (PA) in a substantially ring shape, as shown in FIG. 1 and FIG. 2. The rear lid gasket 12 has a gasket main body section 16 arranged between the inner circumferential surface of the fitting section 13 of the case main body 2 and the outer circumferential surface of the cylindrical section 15 of the rear lid 11, and a spacer section 17 forming a space S between the lower end surface of the case main body 2 and the upper surface of the lid main body section 14, which have been integrally formed, as shown in FIG. 2 and FIG. 3C.

In this embodiment, on the upper surface of the lid main body section 14 positioned on the outer peripheral side of the cylindrical section 15 of the rear lid 11, a fitting groove 18 into which the lower end of the rear lid gasket 12 fits, namely, each lower end of the gasket main body section 16 and the spacer section 17, is annularly provided along the outer periphery of the lid main body section 14, as shown in FIG. 2 and FIG. 3B. Also, on a lower portion of the outer circumferential surface of the cylindrical section 15, a relief recessed section 15*a* is annularly provided along the outer periphery of the cylindrical section 15.

Figure 3C:
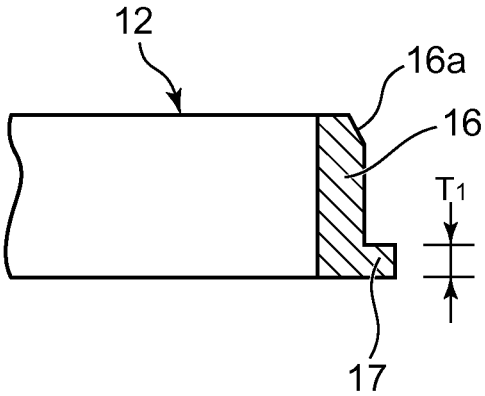

The height of the gasket main body section 16 of the rear lid gasket 12, which is the length in the vertical direction, is equal to a height from the bottom of the fitting groove 18 to the upper end surface of the cylindrical section 15 of the rear lid 11, and the thickness thereof, which is the length of the gasket main body section 16 in the radial direction, is slightly shorter than the thickness of the cylindrical section 15, as shown in FIG. 2 and FIG. 3C.

That is, the thickness of the gasket main body section 16 in the radial direction is set such that the inner circumferential surface of the cylindrical section 15 is substantially flush with the inner circumferential surface of the case main body 2 of the cylindrical section 15 when the gasket main body section 16 and the cylindrical section 15 of the rear lid 11 are arranged inside the fitting section 13 of the case main body 2, as shown in FIG. 2 and FIG. 3C.

Also, on an upper portion of the outer circumferential surface of the gasket main body section 16, a guiding section 16*a* is provided, as shown in FIG. 2 and FIG. 3C. The guiding section 16*a*, which is an inclined surface formed by diagonally cutting out the outer periphery of an upper portion of the gasket main body section 16, is structured to guide the gasket main body section 16 toward the inside of the fitting section 13 when the gasket main body section 16 and the cylindrical section 15 are fitted into the fitting section 13 of the case main body 2.

The outer perimeter of the spacer section 17 of the rear lid gasket 12 is formed to be equal to the inner perimeter of the fitting groove 18 of the rear lid 11 positioned in the outer diameter direction, as shown in FIG. 2. Also, the thickness T1 of the spacer section 17, which is the length in the vertical direction, is formed to be slightly thicker than the depth D1 of the fitting groove 18 of the rear lid 11 (T1>D1), as shown in FIG. 3B and FIG. 3C.

That is, the spacer section 17 is formed such that the upper surface of the spacer section 17 is positioned higher than the upper surface of the lid main body section 14 when the spacer section 17 is arranged inside the fitting groove 18 of the lid main body section 14 and, in this state, the lower end surface of the case main body 2 comes in contact with the upper surface of the spacer section 17 by being pressed, as shown in FIG. 2. As a result, the spacer section 17 is structured such that the space S (=T1−D1) is formed between the lower end surface of the case main body 2 and the upper surface of the lid main body section 14, as shown in FIG. 2. This space S is approximately 0.1 mm.

Figure 4A:
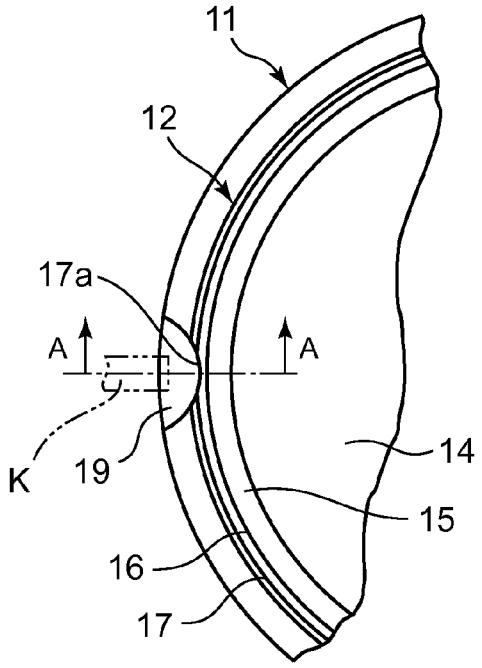
Figure 4B:
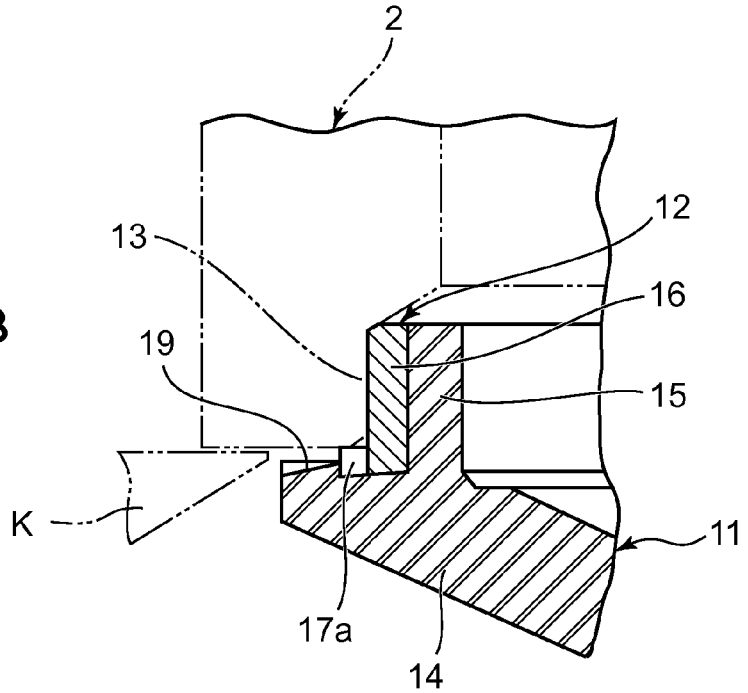

On the upper surface of the lid main body section 14 on the nine o'clock side on the outer peripheral side of the cylindrical section 15 of the rear lid 11, a notched section 19 where a tool K is inserted is provided, as shown in FIG. 4A and FIG. 4B. The notched section 19, which is a surface inclined toward the outer circumferential end of the lid main body section 14, is provided on a portion of the outer periphery of the lid main body section 14 located on the nine o'clock side. As a result, the notched section 19 is structured such that the space S between the lower end surface of the case main body 2 and the upper surface of the lid main body section 14 is gradually widened toward the outer peripheral side.

In this embodiment, a cutout section 17*a* is provided in a portion of the spacer section 17 of the rear lid gasket 12 on the nine o'clock side, corresponding to the notched section 19, as shown in FIG. 4A and FIG. 4B. As a result, in this structure, even when the tool K is inserted into the notched section 19 with the cylindrical section 15 of the rear lid 11 being press-fitted into the fitting section 13 of the case main body 2 via the rear lid gasket 12, and the tip of the tool K reaches the cutout section 17*a* of the spacer section 17, the tool K does not come in contact with the spacer section 17.

That is, the angle of the inclination corner portion of the tip of the tool K is formed larger than the inclination angle of the notched section 19 of the lid main body section 14, as shown in FIG. 4B. As a result, in this structure, the tool K can remove the rear lid 11 from the case main body 2 by opening the upper surface of the lid main body section 14 with respect to the lower surface of the case main body 2 when the tip of the tool K is inserted into the notched section 19 to reach the cutout section 17*a* of the spacer section 17.

Next, the mounting of the rear lid 11 onto the case main body 2 of the wristwatch case 1 is described.

In this embodiment, first, the rear lid gasket 12 is mounted on the rear lid 11. Here, the gasket main body section 16 of the rear lid gasket 12 is attached to the outer periphery of the cylindrical section 15 of the rear lid 11, and the lower end of the rear lid gasket 12 is inserted into the fitting groove 18 annularly provided in the upper surface of the lid main body section 14 on the outer peripheral side of the cylindrical section 15.

In this state, the upper surface of the spacer section 17 has been arranged projecting upward from the upper surface of the lid main body section 14 with the lower end of the gasket main body section 16 of the rear lid gasket 12 and the lower end of the spacer section 17 being fitted into the fitting groove 18 of the lid main body section 14. In addition, the upper end of the gasket main body section 16 of the rear lid gasket 12 has been arranged at the same height as that of the cylindrical section 15 of the rear lid 11.

Then, the rear lid 11 having the rear lid gasket 12 attached thereto is mounted on the lower portion of the case main body 2. Here, the cylindrical section 15 of the rear lid 11 and the rear lid gasket 12 are fitted into the fitting section 13 of the case main body 2 by being pressed from below. In this embodiment, since the guiding section 16*a* has been provided at the upper end of the outer circumferential surface of the gasket main body section 16 of the rear lid gasket 12, the gasket main body section 16 and the cylindrical section 15 of the rear lid 11 are smoothly fitted into the fitting section 13 of the case main body 2 by this guiding section 16*a*.

In this state where the rear lid 11 has been mounted on the lower portion of the case main body 2, the gasket main body section 16 has been press-fitted into an area between the cylindrical section 15 of the rear lid 11 and the fitting section 13 of the case main body 2, and the inner circumferential surface of the cylindrical section 15 of the rear lid 11 is substantially flush with the inner circumferential surface of the case main body 2. As a result of this structure, by the gasket main body section 16, the cylindrical section 15 of the rear lid 11 is fitted into the fitting section 13 of the case main body 2 without coming in contact with the case main body 2.

Also, in this state, the spacer section 17 of the rear lid gasket 12 has been fitted into the fitting groove 18 of the lid main body section 14, the upper surface of the spacer section 17 has been positioned higher than the upper surface of the lid main body section 14, and the lower end surface of the case main body 2 has been pressed against and is in contact with the upper surface of the spacer section 17. As a result, the spacer section 17 forms the space S (approximately 0.1 mm) between the lower end surface of the case main body 2 and the upper surface of the lid main body section 14, as shown in FIG. 2. As a result of this structure, by the spacer section 17, the lid main body section 14 of the rear lid 11 is mounted on the lower portion of the case main body 2 without coming in contact with the case main body 2.

In this state where the rear lid 11 has been mounted on the lower portion of the case main body 2 without coming in contact with the case main body 2, the rear lid gasket 12 ensures waterproofness between the rear lid 11 and the case main body 2 and also ensures impact resistance. In addition, since the case main body 2 and the rear lid 11 do not come in contact with each other, an electrically stable state can be ensured for the entire wristwatch case 1 even if the case main body 2 and the rear lid 11 are made of metal.

Accordingly, even if the timepiece module 10 incorporated inside the wristwatch case 1 includes an antenna (not depicted), the tuning and the receiving sensitivity of the antenna are not hindered, and the antenna can be tuned in an electrically stable state. Therefore, the antenna can be easily and accurately tuned by a simple tuning operation.

When the rear lid 11 is to be removed from the case main body 2, the tool K is inserted into the notched section 19 provided on the nine o'clock side of the rear lid 11. As a result, the rear lid 11 can be easily removed from the case main body 2 even when the cylindrical section 15 of the rear lid 11 has been press-fitted into the fitting section 13 of the case main body 2 via the rear lid gasket 12.

That is, by the insertion of the tip of the tool K into the notched section 19, the upper surface of the lid main body section 14 is opened by the tool K in a direction of moving away from the lower surface of the case main body 2 when the tip of the tool K reaches the cutout section 17*a* of the spacer section 17. As a result, the rear lid 11 can be easily removed from the case main body 2.

As such, this wristwatch includes the metal case main body 2 having the fitting section 13 annularly provided in the lower portion of the inner circumferential surface, the metal rear lid 11 having the lid main body section 14 that is arranged on the lower end of the case main body 2 and the cylindrical section 15 that is arranged in the fitting section 13 of the case main body 2, and the synthetic resin rear lid gasket 12 having the gasket main body section 16 that is arranged between the fitting section 13 of the case main body 2 and the cylindrical section 15 of the rear lid 11 and the spacer section 17 that forms the space S between the lower end surface of the case main body 2 and the upper surface of the lid main body section 14. Therefore, waterproofness can be ensured, and an electrically stable state can be maintained.

That is, in this wristwatch, waterproofness between the fitting section 13 of the case main body 2 and the cylindrical section 15 of the rear lid 11 can be ensured by the gasket main body section 16 of the synthetic resin rear lid gasket 12, and waterproofness between the lower end surface of the case main body 2 and the upper surface of the lid main body section 14 can be ensured by the spacer section 17 of the rear lid gasket 12. This spacer section 17 can also ensure the space S between the lower end surface of the case main body 2 and the upper surface of the lid main body section 14.

Accordingly, in the wristwatch, since a contact between the metal case main body 2 and the metal rear lid 11 can be prevented by the synthetic resin rear lid gasket 12, an electrically stable state can be maintained. Thus, even if the timepiece module 10 incorporated inside the case main body 2 includes an antenna (not depicted), the tuning and the receiving sensitivity of the antenna are not hindered, and the antenna can be easily tuned in an electrically stable state.

In this embodiment, the fitting groove 18 where the lower end of the rear lid gasket 12 is fitted has been annularly provided in the lid main body section 14 of the rear lid 11 along the outer periphery of the lid main body section 14, and the spacer section 17 of the rear lid gasket 12 has been formed having the thickness T1 thicker than the depth D1 of the fitting groove 18 (T1<D1). As a result, the space S (=T1−D1) can be reliably formed between the lower end surface of the case main body 2 and the upper surface of the lid main body section 14, whereby a contact between the lower end surface of the case main body 2 and the upper surface of the lid main body section 14 can be prevented.

Also, in this wristwatch, the cylindrical section 15 of the rear lid 11 has been press-fitted into the fitting section 13 of the case main body 2 via the rear lid gasket 12. Accordingly, waterproofness and shock resistance can be ensured by the rear lid gasket 12, and the rear lid 11 can be reliably mounted on the case main body 2. Thus, the rear lid 11 is not required to be attached to the case main body 2 by screws, and therefore can be formed in any shape without limitation. As a result, the design can be improved.

Moreover, in this wristwatch, the notched section 19 where the tool K is inserted has been provided between the lower end surface of the case main body 2 and the upper surface of the lid main body section 14. Therefore, even when the cylindrical section 15 of the rear lid 11 has been press-fitted into the fitting section 13 of the case main body 2 via the rear lid gasket 12, the rear lid 11 can be easily removed from the case main body 2 only by the tool K being inserted into the notched section 19 between the case main body 2 and the lid main body section 14.

In this embodiment, the cutout section 17*a* has been provided in the spacer section 17 of the rear lid gasket 12 so as to correspond to the notched section 19. Therefore, when the tool K is inserted into the notched section 19 between the case main body 2 and the lid main body section 14 to remove the rear lid 11 from the case main body 2, the tip of the tool K inserted into the notched section 19 can avoid by the cutout section 17*a* so that it does not come in contact with the spacer section 17. As a result, the spacer section 17 is prevented from being damaged by the tool K.

In the above-described first embodiment, the rear lid gasket 12 having the gasket main body section 16 and the spacer section 17 has been formed in an L shape in cross section. However, the present embodiment is not limited to this. For example, a structure may be adopted in which an auxiliary gasket section 20 projecting from the lower end of the gasket main body section 16 and positioned lower than the spacer section 17 has been annularly provided along the same circumference as that of the gasket main body section 16, as shown in a first modification example in FIG. 5.

Figure 5:
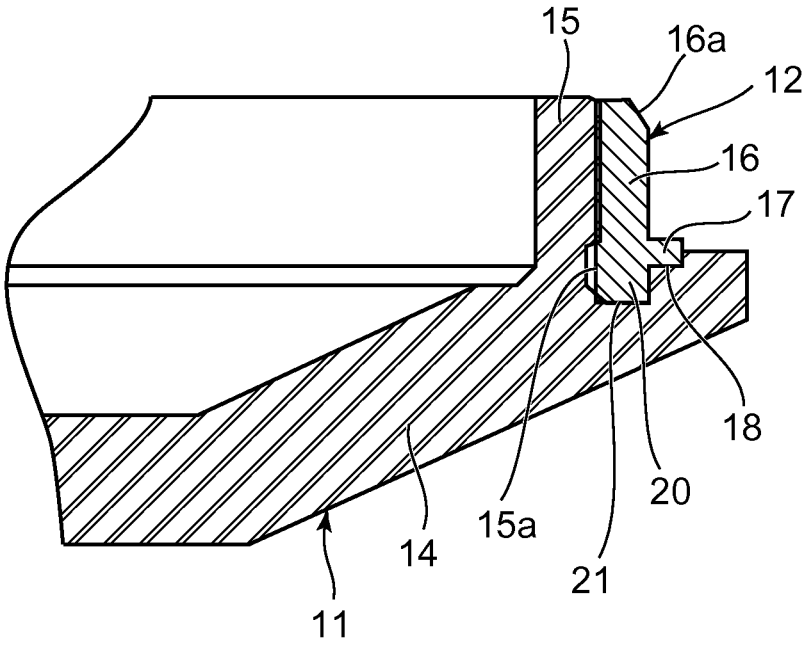
FIG. 5 is an enlarged sectional view of the main portion of a first modification example of the rear lid and the rear-lid gasket in the first embodiment.

In this case, an annular groove 21 where the auxiliary gasket section 20 is fitted may be formed in the bottom of the fitting groove 18 of the rear lid 11, as shown in FIG. 5. In this first modification example, the rear lid gasket 12 can be reliably mounted on the rear lid 11 by the auxiliary gasket section 20. Therefore, when the cylindrical section 15 of the rear lid 11 is to be fitted into the fitting section 13 of the case main body 2, it can be reliably and favorably fitted without the misalignment of the rear lid gasket 12, and the impact resistance can be further ensured.

Also, in the above-described first embodiment, the rear lid gasket 12 having the gasket main body section 16 and the spacer section 17 has been formed in a simple L shape in cross section. However, the present embodiment is not limited to this. For example, a plurality of projecting sections 22 may be provided on the lower end of the rear lid gasket 12 at predetermined intervals along the circumferential direction, as shown in a second modification example in FIG. 6. In this structure, each projecting section 22 should preferably be formed into a hemispherical shape. However, it is not required to be formed into this shape, and may be formed in an arbitrary shape.

In this second modification example, when the spacer section 17 of the rear lid gasket 12 is fitted into the fitting groove 18 provided in the lid main body section 14 of the rear lid 11, the plurality of projecting sections 22 are pressed against the bottom of the fitting groove 18. In this state, when the cylindrical section 15 of the rear lid 11 is fitted into the fitting section 13 of the case main body 2, the plurality of projecting sections 22 come in contact with the bottom of the fitting groove 18 by being pressed. Therefore, the impact resistance can be enhanced more than the first embodiment.

Also, in the above-described first embodiment, the notched section 19 where the tool K is inserted has been provided in the upper surface of the lid main body section 14. However, the notched section 19 is not necessarily required to be provided in the upper surface of the lid main body section 14. For example, the notched section 19 may be provided in the lower surface of the case main body 2, or may be provided in both of the upper surface of the lid main body section 14 and the lower surface of the case main body 2.

Second Embodiment

Next, a second embodiment in which the present invention has been applied to a wristwatch is described with reference to FIG. 7 and FIG. 8A to FIG. 8C. Note that sections identical to those of the first embodiment shown in FIG. 1 to FIG. 4B are provided with the same reference numerals.

Figure 7:
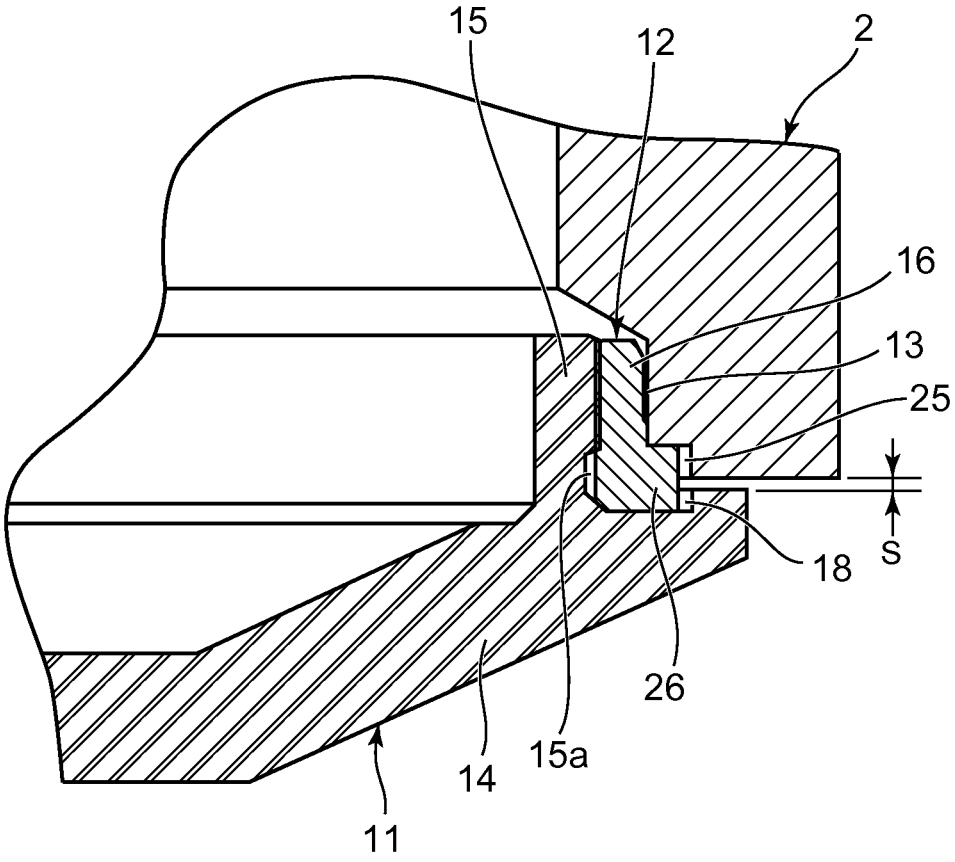
FIG. 7 is an enlarged sectional view of the main portion of an engagement portion between a wristwatch case and a rear lid in a second embodiment in which the present invention has been applied in a wristwatch.

This wristwatch has the same structure as that of the first embodiment except that a fitting recessed section 25 has been provided in the fitting section 13 of the case main body 2 and a spacer section 26 having a shape different from that of the spacer section of the first embodiment has been provided in the rear lid gasket 12, as shown in FIG. 7.

Figure 8A:
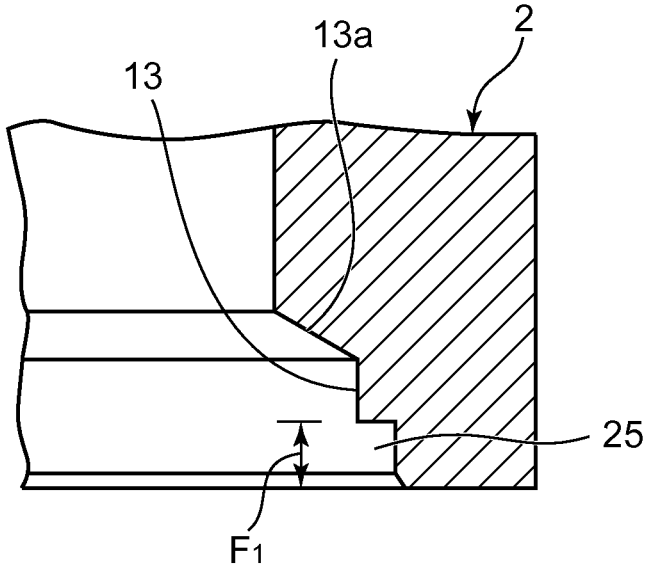
Figure 8B:
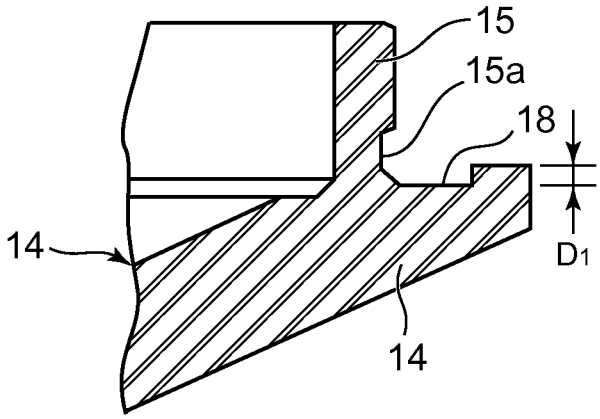

That is, in the fitting section 13 of the case main body 2, the fitting recessed section 25 has been annularly provided along the circumference of the case main body 2, as shown in FIG. 7 and FIG. 8A. This fitting recessed section 25, which is a recessed section having a rectangular shape in cross section, is open on the inner circumferential surface side of the fitting section 13 provided in the case main body 2, and its lower portion is open downward from the lower end of the case main body 2. In this embodiment, the fitting recessed section 25 has been formed to have an inner perimeter equal to that of the fitting groove 18 of the rear lid 11 positioned in the outer diameter direction.

As with the first embodiment, the rear lid gasket 12 is formed of synthetic resin such as polyamide resin (PA) and has a substantially ring shape as a whole. This rear lid gasket 12 has the gasket main body section 16 arranged between the cylindrical section 15 of the rear lid 11 and the fitting section 13 of the case main body 2 and the spacer section 26 forming the space S between the lower end surface of the case main body 2 and the upper surface of the lid main body section 14, which have been integrally formed, as shown in FIG. 7 and FIG. 8C.

Figure 8C:
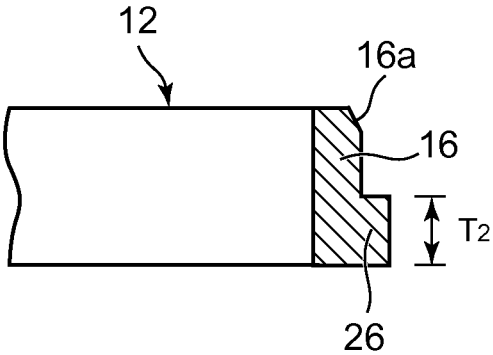

Also, in this embodiment, the height of the gasket main body section 16, which is the length in the vertical direction, is equal to the height from the bottom of the fitting groove 18 of the rear lid 11 to the upper end surface of the cylindrical section 15 of the rear lid 11, and the thickness thereof, which is the length in the radial direction, is slightly shorter than the thickness of cylindrical section 15, as shown in FIG. 7 and FIG. 8C.

That is, the gasket main body section 16 has been formed such that the inner circumferential surface of the cylindrical section 15 is substantially flush with the inner circumferential surface of the case main body 2 when the gasket main body section 16 and the cylindrical section 15 of the rear lid 11 are arranged in the fitting section 13 of the case main body 2, as shown in FIG. 7 and FIG. 8C. Also, the guiding section 16*a* has been provided on the upper portion of the outer circumferential surface of the gasket main body section 16.

The spacer section 26 of the rear lid gasket 12 has been formed such that its outer perimeter is equal to the inner perimeter of the fitting groove 18 of the rear lid 11 positioned in the outer diameter direction and the inner perimeter of the fitting recessed section 25 provided in the fitting section 13 of the case main body 2, as shown in FIG. 7 and FIG. 8C. Also, the spacer section 26 has been formed such that its thickness T2, which is the length in the vertical direction, is slightly thicker than a length (D1+F1) obtained by adding the depth D1 of the fitting groove 18 of the lid main body section 14 in the vertical direction to the height F1 of the fitting recessed section 25 of the case main body 2 in the vertical direction (T2>D1+F1).

That is, the spacer section 26 has been structured such that the lower surface of the spacer section 26 is pressed against and comes in contact with the bottom of the fitting groove 18 of the lid main body section 14 with the spacer section 26 being arranged inside the fitting groove 18 of the lid main body section 14 and inside the fitting recessed section 25 of the case main body 2, the upper surface of the spacer section 26 is pressed against and comes in contact with the upper surface inside the fitting recessed section 25 of the case main body 2, and the space S {=T2(D1+F1)} is formed between the lower end surface of the case main body 2 and the upper surface of the lid main body section 14, as shown in FIG. 7. As with the first embodiment, the space S is approximately 0.1 mm.

In this wristwatch, the fitting recessed section 25 has been annularly provided in the fitting section 13 of the case main body 2 along the circumference of the case main body 2, and the spacer section 26 of the rear lid gasket 12 has been formed having the outer perimeter substantially equal to the inner perimeter of the fitting recessed section 25 of the case main body 2 and the thickness T1 in the vertical direction slightly thicker than the length (D1+F1) obtained by adding the depth D1 of the fitting groove 18 of the lid main body section 14 in the vertical direction to the length F1 of the fitting recessed section 25 of the case main body 2 in the vertical direction (T1>D1+F1). Accordingly, the space S can be reliably formed between the lower end surface of the case main body 2 and the upper surface of the lid main body section 14, whereby a contact between the lower end surface of the metal case main body 2 and the upper surface of the metal lid main body section 14 can be reliably prevented.

In this embodiment, the lower surface of the spacer section 26 is pressed against and comes in contact with the bottom of the fitting groove 18 of the lid main body section 14, and the upper surface of the spacer section 26 is pressed against and comes in contact with the upper surface inside the fitting recessed section 25 of the case main body 2, with the spacer section 26 of the rear lid gasket 12 being arranged inside the fitting groove 18 of the lid main body section 14 and inside the fitting recessed section 25 of the case main body 2. Accordingly, although the space S has been formed between the lower end surface of the case main body 2 and the upper surface of the lid main body section 14, the spacer section 26 can ensure waterproofness between the lower end surface of the case main body 2 and the upper surface of the lid main body section 14. Also, the impact resistance can be enhanced more than the first embodiment.

Thus, in the wristwatch of the second embodiment, a contact between the metal case main body 2 and the metal rear lid 11 can be prevented by the synthetic resin rear lid gasket 12, whereby an electrically stable state can be maintained, as with the first embodiment. Accordingly, even if the timepiece module 10 incorporated inside the case main body 2 includes an antenna (not depicted), the tuning and the receiving sensitivity of the antenna are not hindered, and the antenna can be easily tuned in an electrically stable state.

In the second embodiment as well, a structure such as that shown in the first modification example of FIG. 5 may be adopted in which the auxiliary gasket section 20 projecting from the lower end of the rear lid gasket 12 and positioned lower than the spacer section 17 has been annularly provided along the same circumference as that of the gasket main body section 16, whereby the cylindrical section 15 of the rear lid 11 is reliably and favorably fitted into the fitting section 13 of the case main body 2 without the misalignment of the rear lid gasket 12.

Figure 6:
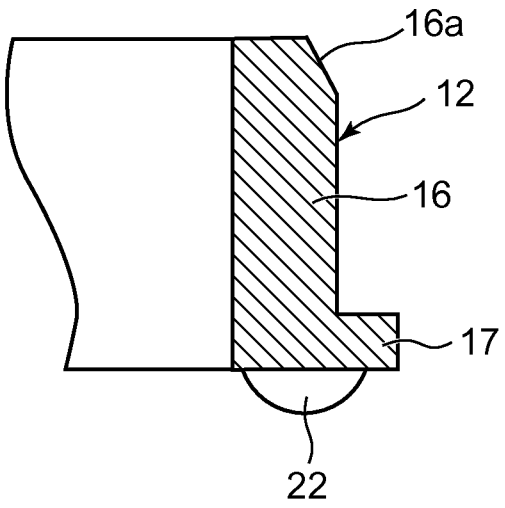
FIG. 6 is an enlarged sectional view of the main portion of a second modification example of the rear-lid gasket in the first embodiment.

Also, in the second embodiment as well, a structure such as that shown in the second modification example of FIG. 6 may be adopted in which the plurality of projecting sections 22 have been provided on the lower end of the rear lid gasket 12 at predetermined intervals along the circumferential direction, and the cylindrical section 15 of the rear lid 11 is reliably fitted into the fitting section 13 of the case main body 2 with the plurality of projecting sections 22 being press-fitted into the bottom of the fitting groove 18 of the rear lid 11. In this structure, the impact resistance can be enhanced more than the second embodiment.

Moreover, in the above-described second embodiment, the fitting groove 18 has been provided in the lid main body section 14 of the rear lid 11, and the fitting recessed section 25 has been provided in the fitting section 13 of the case main body 2 so as to correspond to the fitting groove 18 of the lid main body section 14. However, the fitting groove 18 is not necessarily required to be provided in the lid main body section 14, and the fitting recessed section 25 may be provided in the fitting section 13 of the case main body 2.

Furthermore, in each of the first and second embodiments, the rear lid 11 is press-fitted into the case main body 2 from downside. However, a structure may be adopted in which the rear lid 11 is attached to the case main body 2 by a plurality of portions being attached thereto by screws.

Still further, in the each of the above-described first and second embodiments, the present invention has been applied in a wristwatch. However, the present invention is not necessarily applied to a wristwatch, and can be applied to various timepieces, such as a travel watch, alarm clock, table clock, and wall clock. Yet still further, the present invention is not necessarily applied to a timepiece, and can be widely applied to various electronic devices such as a portable telephone and a portable information terminal.

While the present invention has been described with reference to the preferred embodiments, it is intended that the invention be not limited by any of the details of the description therein but includes all the embodiments which fall within the scope of the appended claims.

What is claimed is:

1. A timepiece comprising:

a metal case having a fitting section which is annularly provided in a lower portion of an inner circumferential surface;

a metal lid body having a lid main body section which is arranged on a lower end of the case and covers a lower portion of the case and a cylindrical section which is arranged in the fitting section of the case; and a synthetic resin gasket having a gasket main body section which is arranged between the fitting section of the case and the cylindrical section of the lid body and a spacer section which forms a space between a lower end surface of the case and an upper surface of the lid main body section.

2. The timepiece according to claim 1, wherein the lid main body section has a fitting groove which is annularly provided along an outer periphery of the lid main body section and into which a lower end of the gasket is fitted, and wherein the spacer section has a thickness thicker than a depth of the fitting groove.

3. The timepiece according to claim 1, wherein the fitting section of the case has a fitting recessed section which is annularly provided along an inner periphery of the case, and wherein the spacer section is formed having an outer perimeter substantially equal to an inner perimeter of the fitting recessed section and a thickness longer than a length of the fitting recessed section in a height direction.

4. The timepiece according to claim 2, wherein the fitting section of the case has a fitting recessed section which is annularly provided along an inner periphery of the case, and wherein the spacer section is formed having an outer perimeter substantially equal to an inner perimeter of the fitting recessed section and a thickness longer than a length of the fitting recessed section in a height direction.

5. The timepiece according to claim 1, wherein the gasket has a plurality of projecting sections which are provided along a circumferential direction at predetermined intervals and come in contact with the lid main body section by being pressed.

6. The timepiece according to claim 2, wherein the gasket has a plurality of projecting sections which are provided along a circumferential direction at predetermined intervals and come in contact with the lid main body section by being pressed.

7. The timepiece according to claim 3, wherein the gasket has a plurality of projecting sections which are provided along a circumferential direction at predetermined intervals and come in contact with the lid main body section by being pressed.

8. The timepiece according to claim 4, wherein the gasket has a plurality of projecting sections which are provided along a circumferential, direction at predetermined intervals and come in contact with the lid main body section by being pressed.

9. The timepiece according to claim 1, wherein the cylindrical section of the lid body is press-fitted into the fitting section of the case via the gasket.

10. The timepiece according to claim 2, wherein the cylindrical section of the lid body is press-fitted into the fitting section of the case via the gasket.

11. The timepiece according to claim 3, wherein the cylindrical section of the lid body is press-fitted into the fitting section of the case via the gasket.

12. The timepiece according to claim 4, wherein the cylindrical section of the lid body is press-fitted into the fitting section of the case via the gasket.

13. The timepiece according to claim 5, wherein the cylindrical section of the lid body is press-fitted into the fitting section of the case via the gasket.

14. The timepiece according to claim 6, wherein the cylindrical section of the lid body is press-fitted into the fitting section of the case via the gasket.

15. The timepiece according to claim 7, wherein the cylindrical section of the lid body is press-fitted into the fitting section of the case via the gasket.

16. The timepiece according to claim 8, wherein the cylindrical section of the lid body is press-fitted into the fitting section of the case via the gasket.

17. The timepiece according to claim 1, wherein a notched section into which a tool is inserted is provided between the lower end surface of the case and the upper surface of the lid main body section.

18. The timepiece according to claim 2, wherein a notched section into which a tool is inserted is provided between the lower end surface of the case and the upper surface of the lid main body section.

19. The timepiece according to claim 17, wherein the spacer section of the gasket has a cutout section provided corresponding to the notched section.

20. The timepiece according to claim 18, wherein the spacer section of the gasket has a cutout section provided corresponding to the notched section.

* * * * *